United States Patent [19]

Siderits et al.

[11] 4,024,973

[45] May 24, 1977

[54] FORKLIFT TRUCK WITH SELECTIVELY CONNECTABLE MAST

[75] Inventors: Robert T. Siderits, Mequon; Reinald D. Liegel, Port Washington, both of Wis.

[73] Assignee: TCI Power Products, Inc., Benson, Minn.

[22] Filed: Aug. 28, 1975

[21] Appl. No.: 608,456

[52] U.S. Cl. ..... 214/674; 187/9 R; 214/750

[51] Int. Cl.[2] ..... B66F 9/20

[58] Field of Search ..... 214/660, 671, 672, 674, 214/673, 750, 75 R, 75 G, 95 A, 620; 187/9 E, 9 R

[56] References Cited

UNITED STATES PATENTS

| | | | |
|---|---|---|---|
| 3,186,571 | 6/1965 | Holzhause | 214/674 |
| 3,851,777 | 12/1974 | Dilny | 214/620 |

FOREIGN PATENTS OR APPLICATIONS

| | | | |
|---|---|---|---|
| 1,024,432 | 2/1958 | Germany | 214/660 |
| 1,292,075 | 4/1969 | Germany | 214/671 |

*Primary Examiner*—Lawrence J. Oresky
*Attorney, Agent, or Firm*—Michael, Best & Friedrich

[57] ABSTRACT

Disclosed herein is a forklift truck including a wheel-supported frame, a mast, pins for selectively mounting the mast to the ground supported frame in either a lower position or an upper position, a grill connected to the mast having a lowered position relative to the mast and being vertically adjustable relative to the mast, a fork structure, and a horizontal rod for selectively mounting the fork structure to the grill so that the fork structure is located adjacent to the ground when the grill is in the lowered position relative to the mast and the mast is mounted in either the lower position or upper position.

4 Claims, 3 Drawing Figures

17
17
11
10
24
30
30
31
25
15
29
28
25
13
12

11
17
25
27
26
31
19
21
16
15
23
20
18
21
13
22
14
20
29

11
17
25
27
31
26
19
16
21
15
23
20
14
22
21
13
29
18
20

FORKLIFT TRUCK WITH SELECTIVELY CONNECTABLE MAST

BACKGROUND OF THE INVENTION

The invention relates generally to forklift trucks, and more particularly, to a forklift truck with a selectively connectable mast.

SUMMARY OF THE INVENTION

The invention provides a vehicle comprising a ground supported frame, a mast, means for selectively mounting the mast to the ground supported frame in one of a lower position and an upper position, a grill connected to the mast and having a lowered position relative to the mast and being vertically adjustable relative to the mast, a fork structure, and means for selectively mounting the fork structure to the grill so that the fork structure is located adjacent to the ground when the grill is in the lowered position relative to the mast and when the mast is mounted in either one of the lower position and the upper position.

In accordance with an embodiment of the invention, the construction of the ground supported frame includes laterally spaced front extensions and laterally spaced tilt cylinders with shafts located above the front extensions, the front extensions and tilt cylinder shafts having, at the outer ends thereof, transverse holes.

Also in accordance with an embodiment of the invention, the mast includes laterally spaced vertically extending side members.

Also in accordance with an embodiment of the invention, the means for selectively mounting the mast to the ground supported frame in one of a lower position and an upper position comprises provision in each of the laterally spaced side members of the mast and at the lower ends thereof, of a first rearwardly mounted bracket and a second bracket mounted above the first bracket, each of the brackets having a lower transverse hole and an upper transverse hole located above the lower transverse hole, and provisions of pins extending through the transverse holes of the front extensions and tilt cylinder shafts, the pins also selectively extending through either one of the upper transverse holes of the brackets to mount the mast in a lower position and the lower transverse holes of the brackets to mount the mast in an upper position.

Still further in accordance with an embodiment of the invention, the grill includes laterally spaced vertically extending side walls, the fork structure includes laterally spaced downwardly extending forks, and the means for selectively mounting the fork structure to the grill so that the fork structure is located adjacent the ground when the grill is in the lowered position relative to the mast and the mast is mounted in either one of the lower position and the upper position, comprises provision in each of the grill side walls of a lower transverse slot and an upper transverse slot located above the lower transverse slot, provision in the upper ends of the downwardly expanding forks of lateral holes, and provision of a horizontal support rod extending through the lateral holes of the forks, with the rod also selectively extending through either of the upper transverse slots of the grill side walls when the mast is in the lower position or the lower transverse slots of the grill side walls when the mast is in the upper position.

One of the principal features of the invention is the provision of a forklift truck including means for selectively mounting the mast to the ground supported frame in either a lower position or an upper position.

Another principal feature of the invention is the provision of a forklift truck including a grill connected to the mast, having a lowered position relative to the mast, and being vertically adjustable relative to the mast.

Another principal feature of the invention is the provision of a forklift truck including means for selectively mounting the fork structure to the grill so the fork structure is located adjacent the ground when the grill is in its lowered position relative to the mast and when the mast is mounted in either the lower position or the upper position.

Other features and advantages of the embodiments of the invention will become known by reference to the following general description, claims, and appended drawings.

THE DRAWINGS

Figure 1:
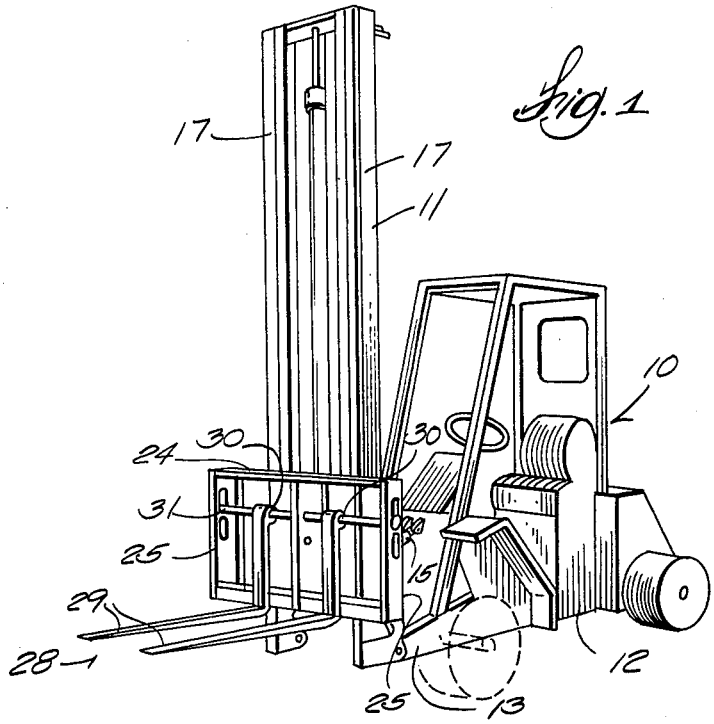
FIG. 1 is a perspective view of a forklift vehicle incorporating various of the features of the invention.

Before explaining the embodiments of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

General Description

Shown in the drawings is a forklift truck 10 which includes a selectively connectable mast 11 embodying various of the features of the invention. More particularly, the forklift truck 10 includes a wheeled frame 12 with front extensions 13 having, at the outer ends thereof, transverse holes 14. The frame 12 has tilt cylinders 15 with shafts having, at the outer ends thereof, transverse holes 16. The tilt cylinders 15 are of a conventional hydraulic type operated to change the inclination of the mast 11 relative to the ground.

The mast 11 has a pair of laterally spaced side members 17, each having at the lower end thereof, a rearwardly extending first bracket 18 and a second bracket 19 located above the first bracket. Each of the brackets 18 and 19 has a lower transverse hole 20 and an upper transverse hole 21 located above the lower transverse hole.

Figure 2:
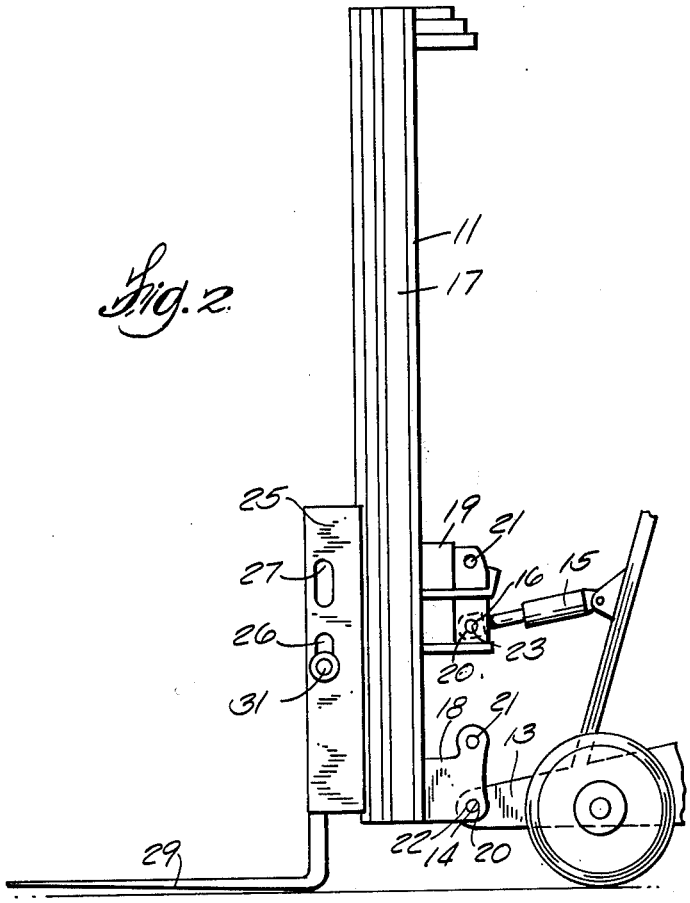
FIG. 2 is a fragmentary plan view of the vehicle in FIG. 1, illustrating the mast mounted to the ground supported frame in an upper position.
Figure 3:
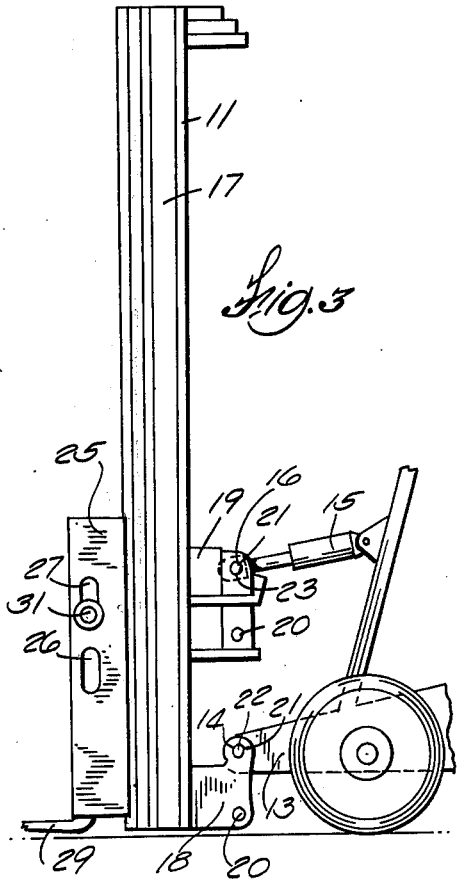
FIG. 3 is a fragmentary plan view of the vehicle of FIG. 1 illustrating the mast mounted to the ground supported frame in a lower position.

Means are provided for selectively mounting the mast 11 to the frame 12 in either one of a lower position and an upper position. Various arrangements can be employed and in the illustrated construction such means comprises pins 22 extending through the transverse holes 14 of the front extensions 13 and other pins 23 extending through the transverse holes 16 of the tilt cylinder shafts 15. The pins 22 and 23 also selectively extend further through either one of the upper transverse holes 21 of the brackets 18 and 19 respectively to mount the mast in a lower position and the lower transverse holes 20 of the brackets 18 and 19 respectively to mount the mast in an upper position. The transverse holes 14 of the front extensions and pins 22, and the transverse holes 16 of the tilt cylinder shafts and pins 23 are shown to be coincident with the lower transverse holes 20 of the brackets 18 and 19 respectively in FIG. 2 and are shown to be coincident with the upper transverse holes 21 of the brackets 18 and 19 respectively in FIG. 3.

A grill 24 is connected through intermediate members to the mast 11. The grill has a lowered position relative to the mast and is vertically adjustable relative to the mast. The grill 24 has laterally spaced side walls 25 having lower transverse slots 26 and upper transverse slots 27 located above the lower transverse slots. Also provided is a fork structure 28 having laterally spaced forks 29 having at the upper ends thereof lateral holes 30.

Means are provided for selectively mounting the fork structure 28 to the grill 24 so that the fork structure is located adjacent the ground when the grill is in its lowered position relative to the mast 11, and when the mast is mounted in either of a lower position for greater vertical clearance and an upper position for greater ground clearance. Various arrangements can be employed and, in the illustrated construction, such means comprises a horizontal support rod 31 which extends through the lateral holes 30 of the forks 29. The rod 31 also selectively extends further through either of the upper transverse slots 27 of the grill side walls 25 when the mast is in a lower position and the lower transverse slots 26 of the grill side walls 25 when the mast is in an upper position.

It is to be particularly noted that the disclosed forklift truck with selectively connectable mast can be utilized advantageously in either an indoor or an outdoor environment. In an indoor environment, the mast of the forklift truck can be mounted in a lower position and carried very low to the ground in order to reduce the overhead height of the truck providing for clearance under finished doorways, etc. In outdoor usage, the mast can be mounted in the upper position some distance above the ground, so that the forklift truck can be operated on uneven ground at construction sites, etc. In the outdoor situation, as well as the indoor situation, when the grill is in its lowered position relative to the mast, the fork structure can be selectively mounted to extend downwardly adjacent the ground. Thus, in accordance with the invention, the fork structure can be selectively mounted on the grill, and the outer mast can be selectively mounted on the truck so that the same mast and fork structure can be used advantageously in both indoor and outdoor enviroments.

While the illustrated construction employs a rod 31 supported in lateral holes 30 in a fork structure 28 and also includes vertically spaced slots 26 and 27 in the grill 24, it is clearly within the scope of the invention to support the rod 31 in the grill 24 and to provide vertically spaced slots in the fork structure 28.

In addition, while the illustrated construction includes vertically spaced holes 20 and 21 on each of the brackets 18 and 19 of the mast 11, together with pins 22 and 23 extending through the holes from the front extensions 13 and the tilt cylinder shafts 15, it is clearly within the scope of the invention to support the pins 22 and 23 on the mast 11 and to provide vertically spaced holes for the pins 22 and 23 on the frame extensions 13 and on the tilt cylinder shafts 13. Alternately, one pair of vertically spaced holes could be provided in the mast 11 and another pair of vertically spaced holes could be provided in one of the front extensions 13 and the tilt cylinder shafts 15.

Various features of the invention are set forth in the following claims.

What is claimed is:

1. A forklift vehicle comprising a ground supported frame, an upright mast including a member adapted to be connected to said frame, means for selectively connecting and disconnecting said member to said ground supported frame in one of a generally vertically extending lower position and a generally vertically extending upper position raised vertically above said lower position and so as to hold said member against vertical movement relative to said frame when said member is connected to same frame, a grill connected to said mast, having a lowered position relative to said mast, and being vertically adjustable relative to said mast, a fork structure, and means for selectively mounting said fork structure to said grill so that said fork structure is located adjacent the ground when said grill is in said lowered position relative to said mast and said mast is mounted in either one of said lower position and said upper position.

2. A vehicle comprising a ground supported frame including laterally spaced front extensions and laterally spaced tilt cylinders with shafts located above said front extensions, said front extensions and tilt cylinder shafts having, at the outer ends thereof, transverse holes, a mast including laterally spaced vertically extending side members each having, at the lower end thereof, a first rearwardly mounted bracket and a second bracket mounted above said first bracket, each of said brackets including a lower transverse hole and an upper transverse hole located above said lower transverse hole, means for selectively mounting said mast to said ground supported frame in one of a lower position and an upper position, and including pins extending through said transverse holes of said front extensions and said tilt cylinder shafts, said pins also selectively extending through either of said upper transverse holes of said brackets to mount said mast in said lower position and said lower transverse holes of said brackets to mount said mast in said upper position, a grill connected to said mast, having a lowered position relative to said mast, and being vertically adjustable relative to said mast, a fork structure, and means for selectively mounting said fork structure to said grill so that said fork structure is located adjacent the ground when said grill is in said lowered position relative to said mast and said mast is mounted in either one of said lower position and said upper position.

3. A vehicle in accordance with claim 1 wherein said grill includes laterally spaced vertically extending sidewalls each having a lower transverse slot and an upper transverse slot located above said lower transverse slot, wherein said fork structure includes laterally spaced downwardly extending forks each having, at the upper end thereof, lateral holes and wherein said means for selectively mounting said fork structure to said grill comprises a horizontal support rod extending through said lateral holes of said forks, said rod also selectively extending through either of said upper transverse slots of said grill sidewalls when said mast is in said lower position and said lower transverse slots of said grill sidewalls when said mast is in said upper position.

4. A vehicle comprising a ground supported frame including laterally spaced front extensions and laterally spaced tilt cylinders with shafts located above said front extensions, said front extensions and tilt cylinder shafts having, at the outer ends thereof, transverse holes, a mast including laterally spaced vertically extending side members each having, at the lower end thereof, a first rearwardly mounted bracket and a second bracket mounted above said first bracket, each of said brackets having a lower transverse hole and an upper transverse hole located above said lower transverse hole, pins extending through said transverse holes of said front extensions and said tilt cylinder shafts, said pins affording selective mounting of said mast to said ground supported frame in either one of a lower position and an upper position by extending further through either of said upper transverse holes of said brackets and said lower transverse holes of said brackets, a grill connected to said mast, having a lowered position relative to said mast, and being vertically adjustable relative to said mast, said grill including laterally spaced vertically extending sidewalls each having a lower transverse slot located above said lower transverse slot, a fork structure including laterally spaced downwardly extending forks each having, at the upper end thereof, lateral holes, and a horizontal support rod extending through said lateral holes of said forks, said support rod affording selective mounting of said fork structure adjacent the ground when said grill is in said lowered position relative to said mast by extending further through either of said upper transverse slots when said mast is in said lower position and said lower transverse slots when said mast is in said upper position.

* * * * *

UNITED STATES PATENT OFFICE

CERTIFICATE OF CORRECTION

Patent No. 4,024,973 Dated May 24, 1977

Inventor(s) Reinald D. Liegel and Robert T. Siderits

It is certified that error appears in the above-identified patent and that said Letters Patent are hereby corrected as shown below:

| | |
|---|---|
| Column 3, line 52 | delete "enviroments", insert ---environments---. |
| Column 4, line 16 | delete "same", insert ---said---. |
| Column 6, line 4 | insert after "transverse slot", ---and an upper transverse slot---. |

Signed and Sealed this

*Sixth* Day of *September 1977*

[SEAL]

*Attest:*

RUTH C. MASON
*Attesting Officer*

LUTRELLE F. PARKER
*Acting Commissioner of Patents and Trademarks*